US006850112B2

(12) United States Patent
Dray

(10) Patent No.: US 6,850,112 B2
(45) Date of Patent: Feb. 1, 2005

(54) DEVICE FOR CONTROLLING A CIRCUIT GENERATING REFERENCE VOLTAGES

(75) Inventor: Cyrille Dray, Grenoble (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 10/470,134

(22) PCT Filed: Jan. 23, 2002

(86) PCT No.: PCT/FR02/00278

§ 371 (c)(1),
(2), (4) Date: Jan. 14, 2004

(87) PCT Pub. No.: WO02/059708

PCT Pub. Date: Aug. 1, 2002

(65) Prior Publication Data

US 2004/0113680 A1 Jun. 17, 2004

(30) Foreign Application Priority Data

Jan. 24, 2001 (FR) ..... 01 00953

(51) Int. Cl.[7] ..... G05F 1/10
(52) U.S. Cl. ..... 327/543; 324/541; 323/315
(58) Field of Search ..... 327/538, 540, 327/541, 543; 323/313, 315

(56) References Cited

U.S. PATENT DOCUMENTS

| | | | | | |
|---|---|---|---|---|---|
| 5,140,191 | A | * | 8/1992 | Nogle et al. | 327/541 |
| 5,473,277 | A | * | 12/1995 | Furumochi | 327/543 |
| 5,966,041 | A | * | 10/1999 | Moane | 327/538 |
| 6,249,174 | B1 | * | 6/2001 | Tsunezawa | 327/538 |
| 6,429,729 | B2 | * | 8/2002 | Kobayashi et al. | 327/540 |
| 6,605,932 | B2 | * | 8/2003 | Sato | 323/313 |
| 6,700,363 | B2 | * | 3/2004 | Tachimori | 323/313 |

* cited by examiner

*Primary Examiner*—Terry D. Cunningham
(74) *Attorney, Agent, or Firm*—Lisa K. Jorgenson; Jose Gutman; Fleit, Kain, Gibbons, Gutman, Bongini & Bianco P.L.

(57) ABSTRACT

Control device for a generation circuit (REF) for reference voltages (VPOL1, VPOL2), includes a first P type MOS transistor (M12), connected between a node (N) to which a high voltage signal (EHV) is applied and a first intermediate node (A), a second P type MOS transistor (M13) connected between the first intermediate node (A) and a second intermediate node (B), and a third P type MOS transistor (M14) connected between the second node and the ground and with its grid connected to its drain, to supply a reference voltage (VPOL1, VPOL2) on one of the first and second intermediate nodes (A, B). The control device includes a controlling mechanism for controlling the reference transistors, either in a first or second operating mode.

9 Claims, 7 Drawing Sheets

DEVICE FOR CONTROLLING A CIRCUIT GENERATING REFERENCE VOLTAGES

CROSS-REFERENCE TO RELATED APPLICATIONS

This application is the National Stage of International Application No. PCT/FR02/00278 filed on Jan. 23, 2002, which is based upon and claims priority from prior French Patent Application No. 0100953 filed Jan. 24, 2001, the entire disclosure of which is herein incorporated by reference.

BACKGROUND OF THE INVENTION

1. Field of the Invention

This invention relates to a device for control of a reference voltage generation circuit. More precisely, this control device is a means of switching reference voltages as a function of a logical control signal, to be applied particularly as cascode transistor bias voltages in a high voltage level translator.

2. Description of Related Art

One example application relates to integrated circuits comprising non-volatile electrically programmable memories.

These memories are programmed using a voltage higher than the logic power supply voltage Vcc of the integrated circuit. The nominal value of this high programming voltage depends essentially on the technology considered.

This high voltage is usually applied to an element of the integrated circuit, for example a memory row, using a high voltage translator, also called a level translator.

This translator receives a logical control signal and a high voltage input as inputs. Either the ground or the high voltage input level will be obtained at the output from the translator, depending on the logical level Vcc or 0 of the logical control signal, which in the case of a memory will be derived from a write control signal. These translators are well known to those skilled in the art.

These translators usually comprise an intermediate stage, between the high transistors stage and the low transistors stage. This intermediate stage comprises one or several cascode stages. It limits voltage at internal nodes in the translator to intermediate levels, such that no transistor in the translator will have an excessively high voltage applied to its terminals.

One example of a translator with this type of cascode stage using the CMOS technology is shown in FIG. 1.

In this example, the high stage comprises a P type MOS transistor M1 in the first branch, and a P type MOS transistor M2 in the second branch. The source of these transistors is connected to the high voltage input node $E_{HV}$.

The low stage comprises an N type MOS transistor M3 in the first branch, and an N type MOS transistor M4 in the second branch. The source of these transistors is connected to the ground $G_{ND}$.

The cascode stage comprises four MOS transistors: two P type MOS transistors M5 and M6, one in each branch, under each high transistor and two N type MOS transistors M7 and M8, one in each branch above each low transistor. The reference voltage $V_{REFP}$ is applied to the grid of P MOS transistors M5 and M6. The reference voltage $V_{REFn}$ is applied to the grid of N MOS transistors M7 and M8.

The translator output VOUT is taken between the N and P cascode transistors of one branch, at the drains of transistors M6 and M8 in the example.

The grid of the low transistor M3 of the first branch of the translator receives a logical switching signal denoted IN, and the grid of the low transistor M4 of the second branch of the translator receives the inverse signal denoted /IN.

The role of the cascode stage is to limit voltages applied to transistors in the translator to intermediate levels.

Cascode transistors in a translator are usually biased by logic power supply voltages $V_{CC}$ (N MOS cascode transistors) and GND (P MOS cascode transistors). In other translators they are biased by reference voltages $V_{REFn}$, $V_{REFP}$ generated from the high voltage.

In French patent application No. 99 09970 deposited on Jul. 30, 1999, it is shown that neither of the two bias modes is satisfactory. If the translator is not used, the standby level of the high voltage node $E_{HV}$ is less than or equal to $V_{CC}$. The high voltage is applied in the form of a voltage ramp that moves the high voltage node from its standby value to a nominal high voltage value, $V_{PP}$. Thus, the voltage level at node $E_{HV}$ is firstly less than or equal to the logic power supply voltage level $V_{CC}$ and then increases to become equal to its nominal value $V_{PP}$. Regardless of the method chosen to bias the cascode transistors, this bias is fixed and determined. The application shows that the bias of the cascode transistors then has an influence on the operating range of the translator, or on the stress of the translator transistors, related to the increase in voltage on the high voltage node $E_{HV}$.

In the application mentioned above, and as shown in FIG. 1, a control device is provided comprising a voltage reference circuit REF and a control circuit COM, so as to obtain voltage references as a function of the level of the high voltage input $E_{HV}$. This control device is applied to the high voltage translator to make the translator switch over in the low values of the high voltage input (standby level), by switching reference voltages equal to the logic power supply voltages $V_{CC}$ and $G_{ND}$, as cascode transistor bias voltages. Once the transistors have switched over, the level of the high voltage input may increase to its nominal value $V_{PP}$ at no risk for the translator transistors. The control device then switches the reference voltages $V_{REFn}$, $V_{REFP}$ defined by putting the transistors in the reference circuit mounted as a diode between the high voltage node and the ground in series, as the bias voltages for the cascode transistors.

The translator output then follows the increase in voltage of the high voltage input $E_{HV}$ with the advantages of a bias of cascode transistors by the reference voltages $V_{REFn}$, $V_{REFP}$. As long as node $E_{HV}$ remains at its nominal value $V_{PP}$, the translator can switch over in one direction or the other, with these bias voltages. As soon as node $E_{HV}$ returns to its standby level, $V_{CC}$ in the example, the voltages $V_{CC}$ and $G_{ND}$ are applied as the bias voltages. Thus, the translator operating window is made wider (switching at low voltage) and its translators are no longer subjected to any stress due to the high voltage node changing from its standby position, $V_{CC}$ in the example, to its nominal value $V_{PP}$.

As shown in detail in FIG. 1, according to the application mentioned above, the circuit REF also comprises three P type MOS transistors M12, M13 and M14 connected in series between the node N carrying the high voltage input $E_{HV}$ and the ground $G_{ND}$. The grids of the first and third transistors M12 and M14 are each connected to their drain. The second transistor M13 is controlled through a control circuit COM. Its drain and its source supply a first reference voltage $V_{POL1}$ and a second reference voltage $V_{POL2}$ respectively. These voltages are applied in the example as bias voltages for the cascode transistor grid in the high voltage translator.

The control circuit COM controls the grid, drain and source voltage of the second transistor M3 as a function of the level of a control signal /WR.

Operation of this type of control device is shown in FIGS. 2 and 3, in an example in which the standby level of the high voltage input $E_{HV}$ is $V_{CC}$.

When the control signal /WR is at a first logical level, "1" in the example, the transistor M13 is blocked and its drain and its source are forced to $V_{CC}$ and $G_{ND}$ respectively, by means in the control circuit COM. We then have $V_{POL1}=V_{CC}$ and $V_{POL2}=G_{ND}$.

When the control signal /WR is at the second logical level, "0" in the example, the drain and grid of transistor M13 are connected together such that it is installed as a diode, like the other two transistors M12 and M14 in the reference circuit. These reference transistors M12, M13 and M14 in the reference circuit then set up voltage levels at nodes A and B, depending on the level on the high voltage input $E_{HV}$. The result is then $V_{POL1}=V_{REFn}$ and $V_{POL2}=V_{REFP}$.

Thus, the different reference voltages are switched depending on the level of the logical control signal /WR. In the example of an application to the bias of cascode transistors of a high voltage translator, the first operating mode (/WR equal to "1"), corresponds to the high voltage input at its standby level, $V_{CC}$ in the example, and the second operating mode (/WR equal to "0") corresponds to the high voltage input increasing to its nominal value $V_{PP}$.

The control circuit COM comprises mainly four MOS transistors M15, M16, M17 and M18 as shown in FIG. 1.

The P type MOS transistor M15 is connected between the logic power supply voltage $V_{CC}$ and the first intermediate node A in the reference circuit REF connected to the source of transistor M13.

The N type MOS transistor M16 is connected between the second intermediate node B in the reference circuit connected to the drain of transistor M13, and the ground $G_{ND}$.

The P type MOS transistor M17 is connected between the logic power supply voltage $V_{CC}$ and the grid of transistor M13.

The transistor M18 is connected between the grid and the drain (node B) of the second transistor M13.

The transistors M16 and M18 are controlled on their grid by the logical control signal /WR of the control circuit and the transistor M15 is controlled by a signal VNP referenced to the high voltage input $V_{NP}$ and output from the signal /WR and with inverse logic.

The grid of transistor M17 is connected to the second intermediate node B.

This control circuit operates as follows:

When the /WR signal is equal to "1", transistor M16 is conducting and pulls the second intermediate node B to zero, and consequently also pulls the grid of transistor M17.

Transistor M18 is blocked. Transistor M17, that is conducting, carries the voltage $V_{CC}$ to the grid of transistor M13, which is then forced into the blocked state.

Transistor M15 is also conducting, since the signal $V_{NP}$ has the inverse logic to signal /WR. Therefore, it carries the voltage $V_{CC}$ to the first intermediate node A.

Since transistor M13 is forced to the blocked state by transistors M16 and M17 in the control circuit, the intermediate nodes A and B are consolidated at their levels $V_{CC}$ and $G_{ND}$ respectively, regardless of the voltage level on the high voltage input.

When the signal /WR changes to "0", corresponding to an increase in the voltage of the high voltage input $E_{HV}$ from $V_{CC}$ to its nominal value $V_{PP}$, transistors M15 and M16 change to the blocked state and consequently transistor M17 changes to the blocked state as well. Transistor M18 becomes conducting and actively connects the grid of transistor M13 to the second intermediate node B, in other words to its drain. Transistor M13 is then connected as a diode like the other transistors M12 and M14 in the reference circuit. The result is normal operation of the reference circuit; voltages at nodes A and B follow the rise in voltage of the high voltage input EHV.

Since the transistor M15 in the control circuit is connected between the logic power supply voltage $V_{CC}$ and node A, and transistor M12 in the reference circuit is connected between the high voltage input $E_{HV}$ and node A, when this high voltage input $E_{HV}$ reaches high values, it is important to be sure that transistor M15 is actually blocked, to avoid sending the high voltage to the logic power supply voltage $V_{CC}$.

This is why transistor M15 must receive the voltage output from a high voltage input $E_{HV}$ on its grid and not the high level corresponding to the logic power supply voltage $V_{CC}$. When the high voltage input reaches its nominal value $V_{PP}$, this value $V_{PP}$ also appears on the grid of transistor M15.

This is obtained in the example by means of an inverter circuit with three MOS transistors. A first P type MOS transistor M19, a second N type MOS transistor M20, and a third N type MOS transistor M21, are connected in series between node N carrying the high voltage input $E_{HV}$ and the ground $G_{ND}$.

Transistor M21 is controlled on its grid by the /WR control signal.

The grids of transistors M20 and M19 are connected together to the first intermediate node A;

The inverse logical signal $V_{NP}$ referenced to $E_{HV}$ by the inverter is supplied by the serial connection point between the two transistors M19 and M20. This is the signal applied to the grid of transistor M15.

Operation is as follows: when the /WR binary signal is equal to 1, transistor M21 is conducting and connects transistor M20 to the ground. Node A is at $V_{CC}$. Since the high voltage input $E_{HV}$ is then at its low voltage standby level (in the example equal to $V_{CC}$, see FIGS. 2 and 3), and therefore transistor M19 is blocked. Transistor M20 is conducting. Therefore, the voltage on the grid of transistor M15 is equal to 0: $V_{NP}=0$.

The sizes of MOS transistors 19, 20 and 21 are such that, even if the value of the high voltage input $E_{HV}$ is greater than $V_{CC}$, $V_{NP}$ remains below $V_{CC}-V_{tp}$, such that the translator operates even for high values of the high voltage input (in other words it can flip over).

When the /WR binary signal is equal to "0" and the high voltage input $E_{HV}$ rises from $V_{CC}$ to $V_{PP}$, transistor M21 is not conducting and the transistor M20 source is put to a floating potential.

The potential $V_{NP}$ is not pulled to the ground. Therefore, transistor M15 is blocked. If input $E_{HV}$ is equal to $V_{PP}$, node A is biased by transistor M12 at a voltage less than $V_{PP}-V_{tp}$. Transistor M19 is conducting and $V_{NP}$ is pulled to $V_{PP}$. The stable position is given by $V_{NP}=V_{PP}$, with M15 blocked and $V_{REFn}$ is less than $V_{PP}-V_{tp}$.

One problem with this control device is due to the complex control of transistor M15, requiring three transistors M19, M20 and M21 to reliably block it or to make it conducting, depending on the /WR control signal.

One purpose of the invention is to reduce the number of transistors in the control circuit while maintaining the function of the control device, in other words a reference voltage source.

SUMMARY OF THE INVENTION

In the invention, a control circuit is suggested in which in particular the transistor M12 of the reference circuit is no longer directly installed as a diode, but is controlled by control means through which it operates either as a current source or as a diode.

Therefore, the invention as claimed relates to a control device for a generation circuit REF for reference voltages $V_{POL1}$, $V_{POL2}$, comprising a first P type MOS transistor M12 connected between a node N to which a high voltage signal $E_{HV}$ is applied and a first intermediate node A, a second P type MOS transistor M13 connected between the first intermediate node A and a second intermediate node B, and a third P type MOS transistor M14 connected between the second node and the ground and with its grid connected to its drain, to supply reference voltages $V_{POL1}$, $V_{POL2}$ on intermediate nodes A and B. This device comprises means of controlling the reference transistors, either in a first operating mode to force the first reference transistor M12 to a current source, the second reference transistor M13 to the blocked state and to short circuit the third reference transistor M14 to the ground, or in a second operating mode to connect each of the said transistors as diodes, their grid and their drain being connected as a function of a /WR logical control signal.

BRIEF DESCRIPTION OF THE DRAWINGS

Other characteristics and advantages of the invention are described in detail in the description of the invention given below, which is provided for information and is in no way limitative, with reference to the appended drawings, wherein:

FIG. 2 shows the shape of the signal $V_{OUT}$ obtained at the output from the translator in FIG. 1 as a function of the switching control signal IN;

DETAILED DESCRIPTION OF PREFERRED EMBODIMENTS

Figure 4:
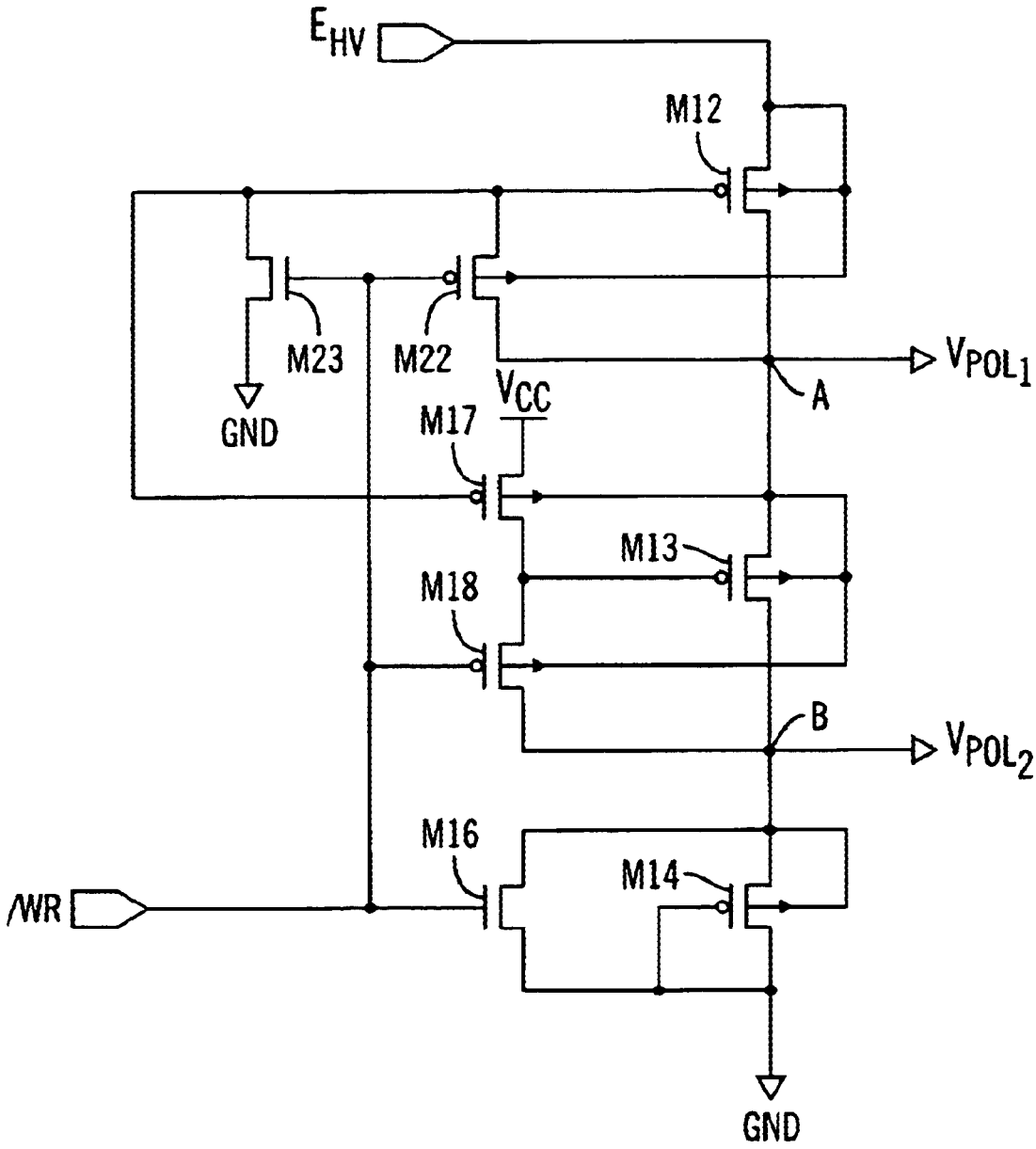
FIG. 4 shows a control device according to this invention.

FIG. 4 shows a control device according to the invention. This control device may supply reference voltages $V_{POL1}$, $V_{POL2}$ at the output that depend on a logical control signal /WR applied to the input of the said device:

Either /WR=0 and $(V_{POL1}, V_{POL2})=(V_{CC}, 0)$ corresponding to a first operating mode, in practice related to the case in which the high voltage input $E_{HV}$ is at its standby level $V_{CC}$.

Or /WR=0 and $(V_{POL1}, V_{POL2})=(Vref_n, Vref_p)$, corresponding to a second operating mode.

The second operating mode corresponds to the case in which the high voltage input changes to its nominal value $V_{PP}$. Reference voltages are then set up by reference transistors M12, M13 and M14 installed as diodes, and as a function of the level of the high voltage input $E_{HV}$.

Figure 1:
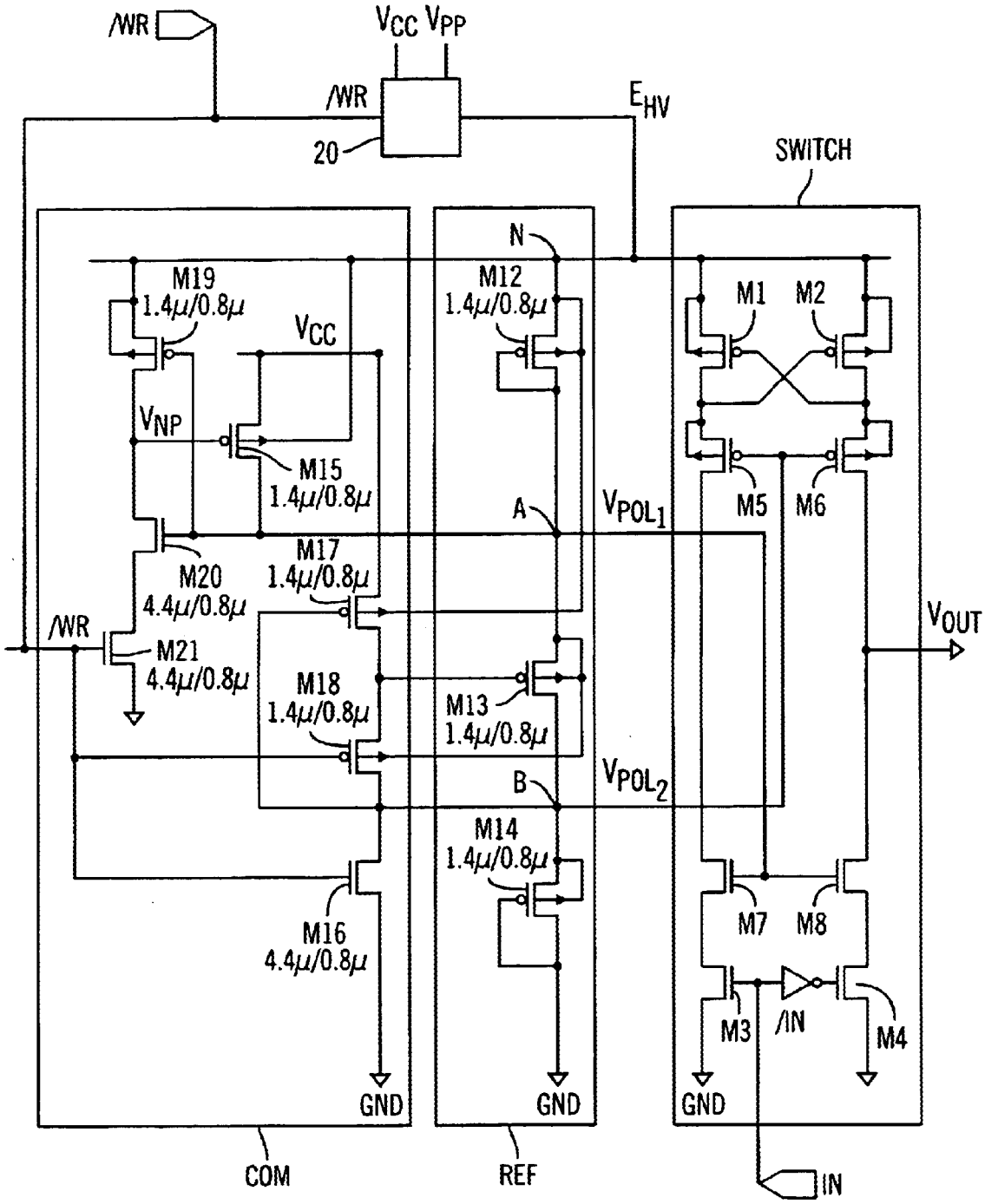
FIG. 1 PRIOR ART
FIG. 1, already described, represents a high voltage cascode staged translator and a reference voltage control device according to the state of the art.
Figure 2:
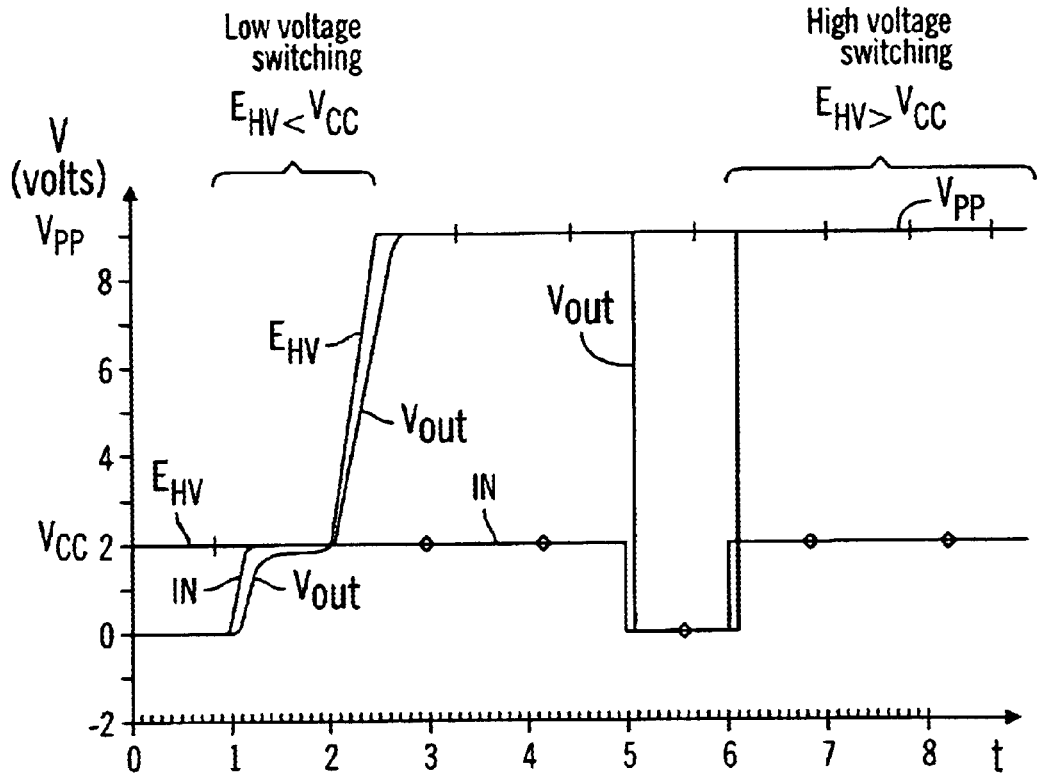
Figure 3:
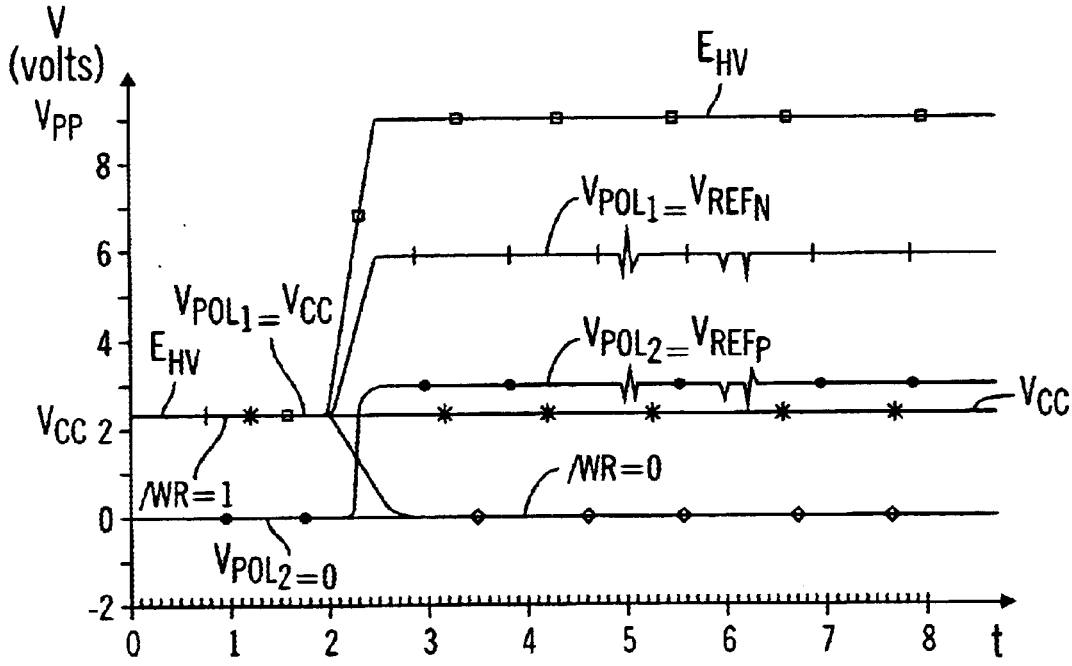
FIG. 3 shows the shape of the high voltage input, the control signal of the control circuit according to the control device in FIG. 1, and the corresponding curves of the reference voltages obtained.

Elements common to the state of the art shown in FIG. 1 are marked with the same references in FIG. 4, to make the description more easily understandable.

Thus, the reference circuit REF comprises three P type MOS transistors M12, M13 and M14, connected in series between the node N to which the high voltage input $E_{HV}$ is connected, and the ground $G_{ND}$.

The source and drain of the second transistor M13 output the first reference voltage $V_{POL1}$ on the first intermediate node A of the reference circuit REF, and the second reference voltage $V_{POL2}$ on the second intermediate node B.

For example, these reference voltages may be applied as grid bias voltages on cascode transistors in a high voltage translator.

In the reference circuit according to the invention, only the third transistor M14 has its grid connected to its drain. The first and second transistors M12 and M13 are controlled by a control circuit COM according to the invention.

This control circuit comprises means of controlling the first transistor M12 of the reference circuit either to make it operate as a current source or to make it operate as a diode. These control means comprise a first P type MOS transistor M22, connected between the grid and drain of the P type MOS transistor M12, and a second N type MOS transistor M23 connected between the grid of the P type MOS transistor M12 and the ground $G_{ND}$. The grids of the transistors M22 and M23 are connected in common and are controlled by the control signal /WR.

Thus, when this /WR signal is equal to "1", corresponding to the first operating mode of the control device, the input $E_{HV}$ being at its standby level $V_{CC}$, the transistor M22 is blocked, while transistor M23 is conducting and brings the grid of the first reference transistor M12 to $G_{ND}$. This transistor then is clearly conducting to bring its drain to the level $E_{HV}$ of its source. Since the input $E_{HV}$ is at its standby level $V_{CC}$, we obtain $V_{POL1}=V_{CC}$.

When this signal /WR is equal to "0" corresponding to the second operating mode of the control device, the input $E_{HV}$ increases to its nominal level $V_{PP}$, the transistor M23 is blocked, while transistor M22 is conducting and short circuits the grid and the drain of the first reference transistor M12; it is equivalent to a diode.

The control means of the second reference transistor M13 include P type MOS transistors M17 and M18 connected in series between the logic power supply voltage $V_{CC}$ and the drain of the second reference MOS transistor M13. The transistor M18 is controlled by the /WR logical signal, but the grid of transistor M17 is no longer controlled by the source of the third reference transistor. In the control circuit according to the invention, the grid of the transistor M17 is controlled like the grid of the first reference transistor M12. In other words, their grids are connected together.

Either the /WR signal is equal to "1", and the transistor M17 is clearly conducting, through the transistor M23 that forces its grid to 0. Transistor M17 then brings the grid of the second reference transistor M13 to $V_{CC}$; the transistor M13 is blocked. Transistor M18 is blocked.

Or the /WR signal is equal to 0, and transistor M17 is clearly blocked. Transistor M18 is conducting and short circuits the grid and the drain of the second reference transistor M13 to $V_{CC}$; the transistor M13 is installed as a diode.

Finally, there is the N type MOS transistor M16 connected in parallel on the third reference transistor M14 and controlled on its grid by the logical control signal /WR, either to pull the node B to the ground $G_{ND}$, which is equivalent to short circuiting the reference transistor M14 (/WR equal to "1) or actively leave this reference transistor M14 installed as a diode in the reference circuit REF.

With the control circuit according to the invention, when the /WR signal is equal to "0", normal operation of the reference circuit is restored with its three reference transistors M12, M13 and M14 actively connected as diodes, in series between the high voltage input and the ground, to set up reference voltages depending on the level of this high voltage input.

Figure 6:
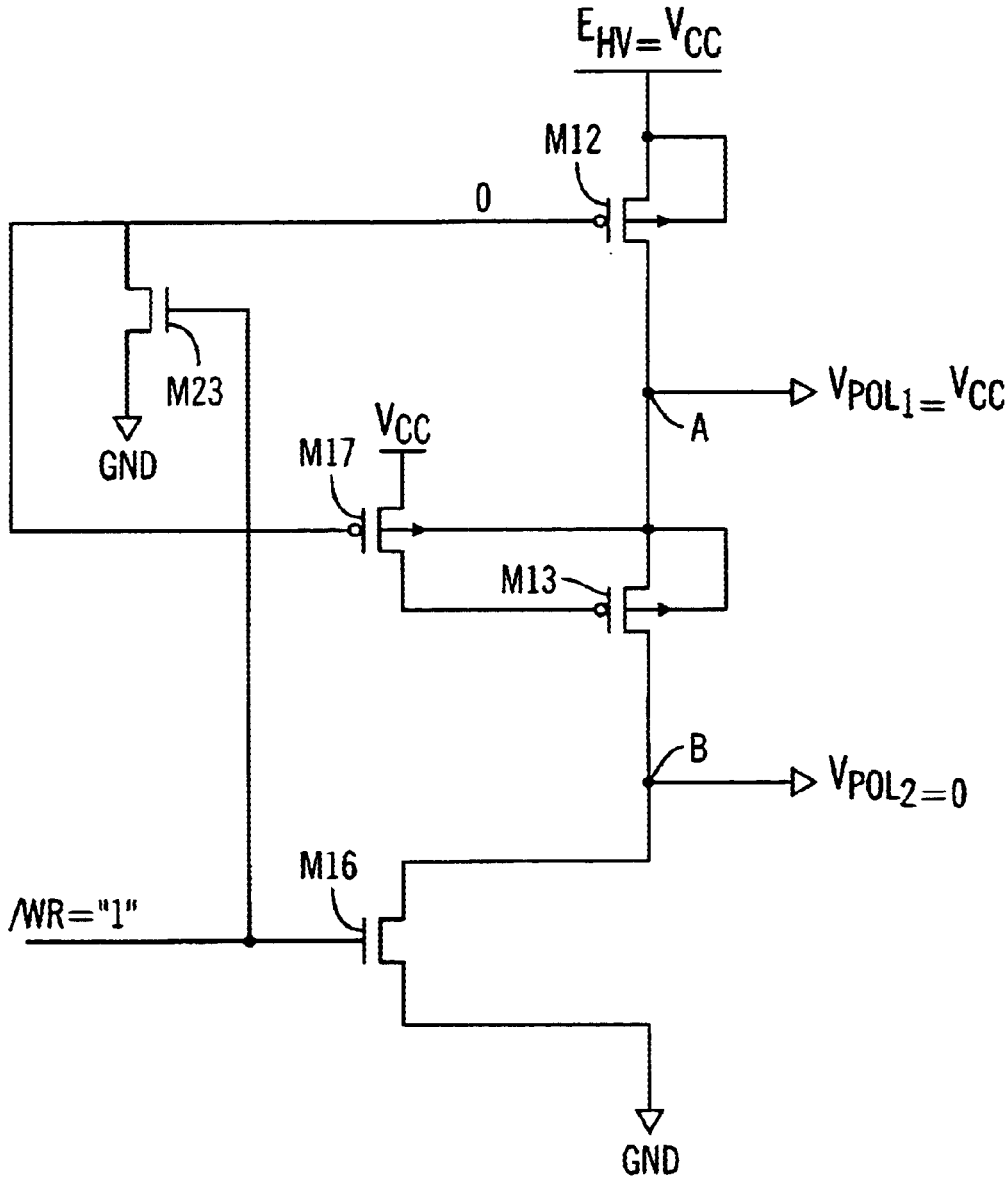
FIG. 6 shows the equivalent diagram for the device in FIG. 5, when the /WR control signal is equal to "1"
Figure 7:
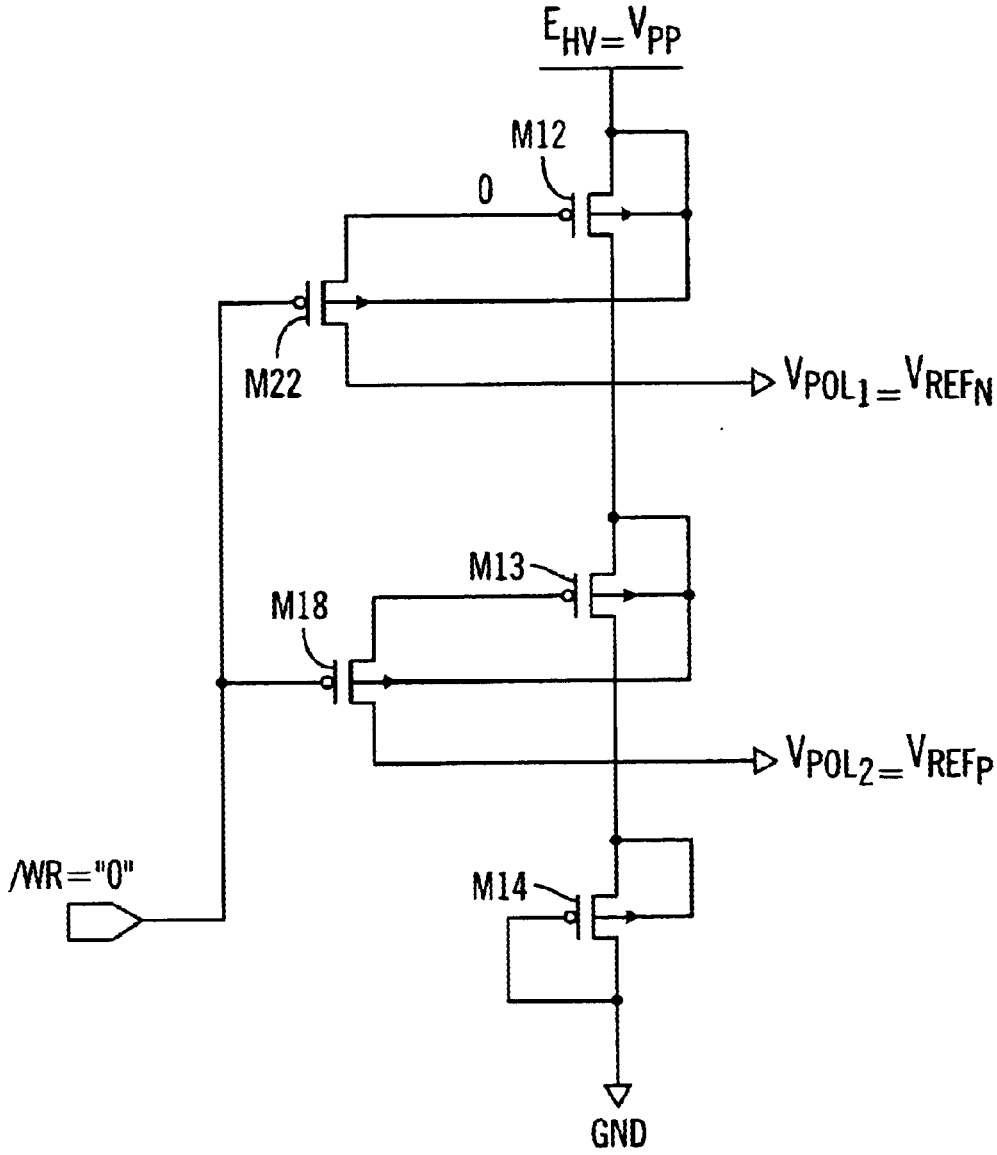
FIG. 7 shows the equivalent diagram of the device in FIG. 5 when the control signal /WR is equal to "0"

FIGS. 6 and 7 show operation of the control device according to the invention. The equivalent diagram for the control device when /WR is equal to "1" is shown in FIG. 6. The $E_{HV}$ input is at its standby level $V_{CC}$. The second reference transistor M13 is blocked, while the first reference transistor M12 pulls node A to $E_{HV}=V_{CC}$ and the third transistor M14 pulls node B to $G_{ND}$. The equivalent diagram of the control device when /WR is equal to "0" is shown in FIG. 7. The high voltage input rises or is set to its nominal level $V_{PP}$. The three reference transistors M12, M13 and M14 are installed as diodes between the high voltage input $E_{HV}$ and the ground, pulling node A and the node B to reference levels $V_{REFn}$ and $V_{REFp}$, depending on the level of the high voltage input.

Figure 5:
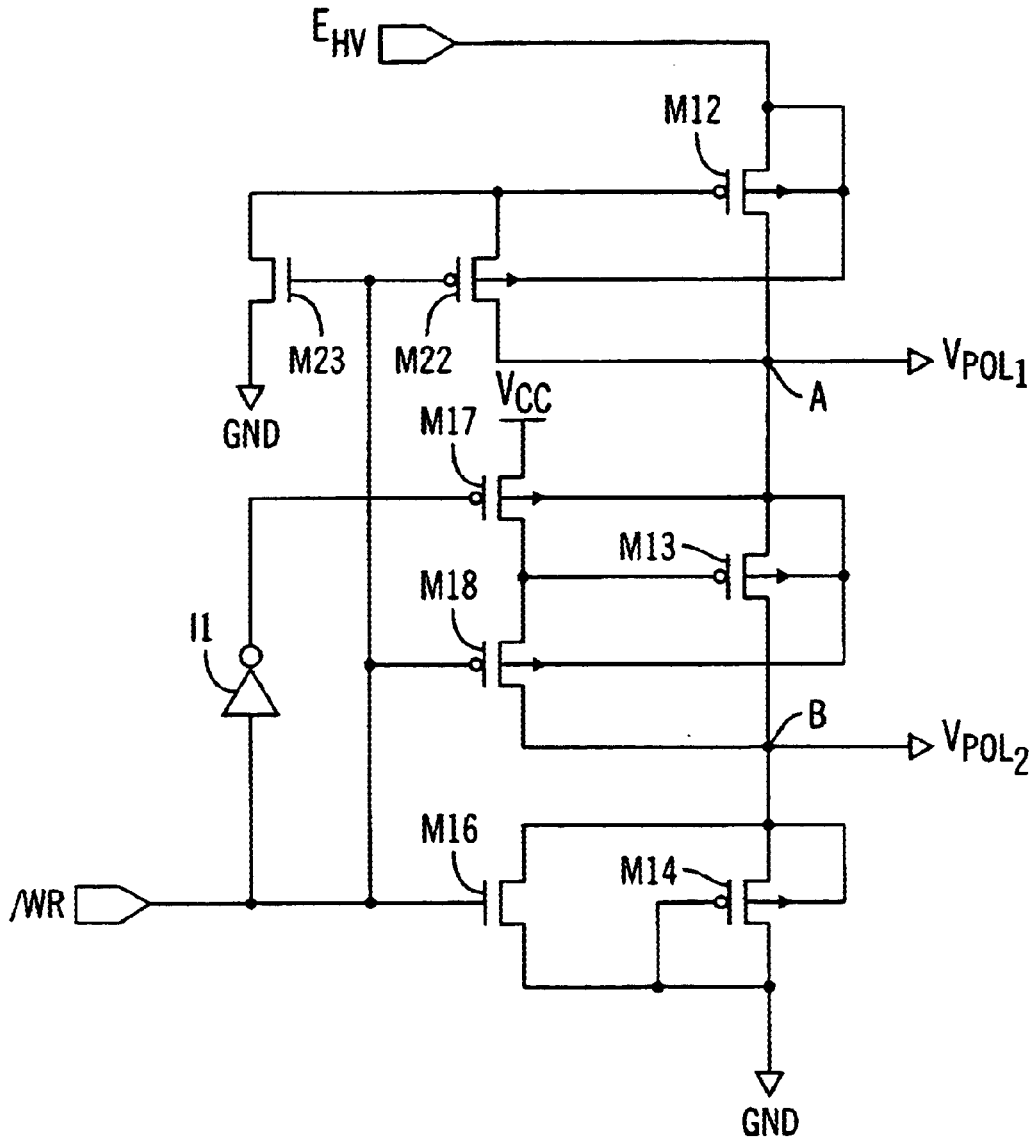
FIG. 5 shows a variant of this device.

FIG. 5 shows a variant of a control device in which the grid of transistor M17 is controlled directly by the control signal /WR through an inverter I1 (apparently always the same problem for this grid control).

With the control device according to the invention, the number of transistors is reduced, as a result of the simplification to the control circuit.

Figure 8:
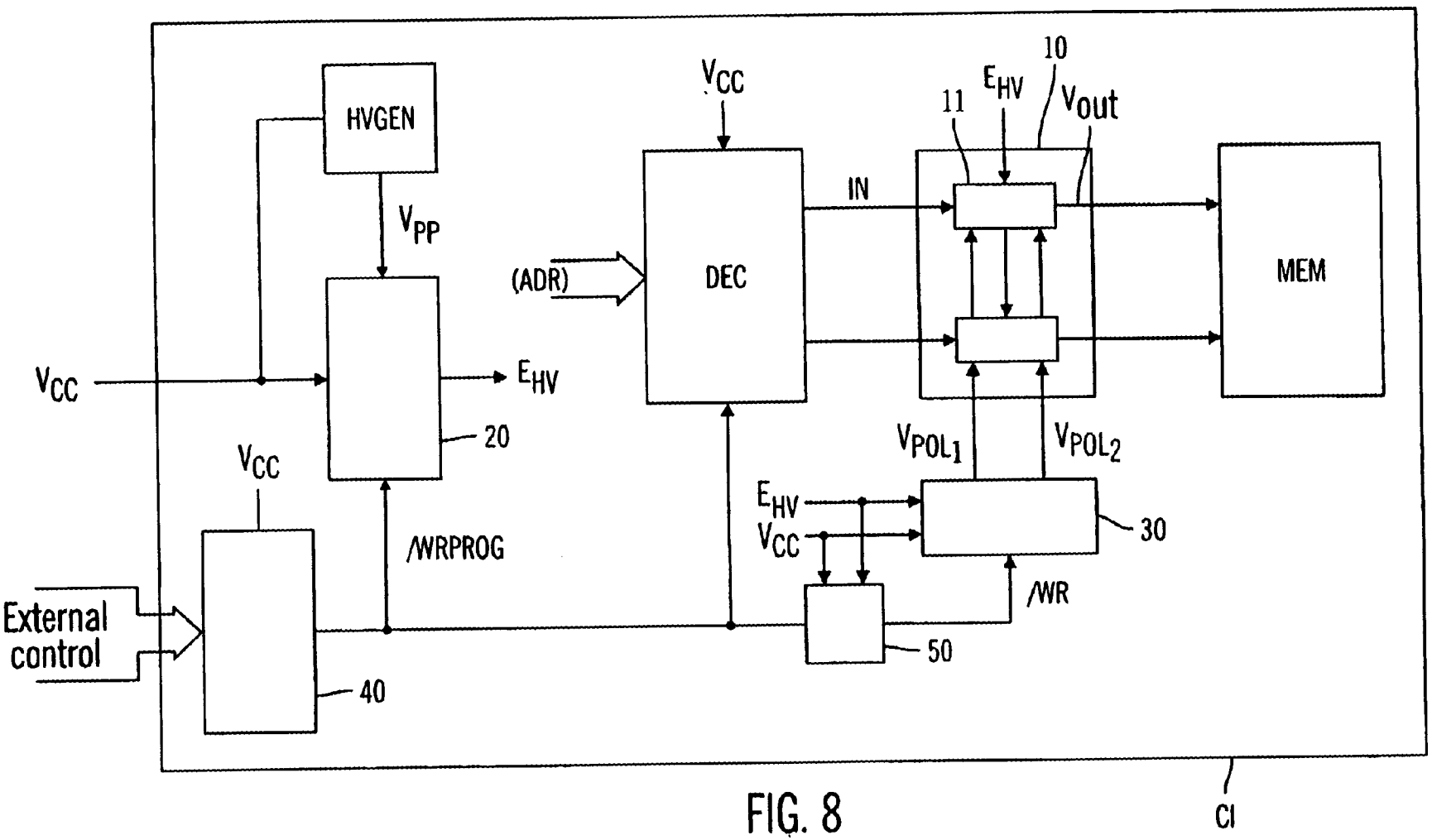
FIG. 8 diagrammatically shows an integrated circuit comprising such a control device.

The control device according to the invention is particularly suitable for outputting bias voltages of cascode transistors in at least one high voltage translator. It is quite naturally but not exclusively applicable to the field of programming non-volatile memories. An example of this type of application is diagrammatically shown in FIG. 8. The integrated circuit IC illustrated thus comprises electrically programmable non-volatile memory cells MEM, and at least one high voltage translator 10 to apply a programming voltage $V_{FF}$ at the output $V_{OUT}$ of these cells. This translator receives bias voltages $V_{POL1}$ and $V_{POL2}$ from the cascode transistors of a control device 30 with a voltage reference source according to the invention, as a function of the /WR control signal.

The level of these bias voltages supplied by this control device depends on this control signal /WR. In practice, this control signal itself depends on the level of the high voltage input $E_{HV}$, and in the example, supplied by a circuit 50 to make a comparison with a determined threshold of the level of this input. Note that this type of control device can supply bias voltages for several high voltage translators.

What is claimed is:

1. A control device for a generation circuit for reference voltages, comprising:

a first P type MOS transistor, connected between a node to which a high voltage signal is applied and a first intermediate node, a second P type MOS transistor connected between the first intermediate node and a second intermediate node, and a third P type MOS transistor connected between the second intermediate node and the ground and with its grid connected to its drain, to supply a reference voltage on one of the said intermediate nodes, and wherein the control device further comprises means of controlling the said reference transistors, either in a first operating mode to force the first reference transistor to act as a current source, the second reference transistor to the blocked state and to short circuit the third reference transistor to the ground, or in a second operating mode to connect each of the said transistors as a diode, the grids and drains of the first and second transistors being connected as a function of a logical control signal.

2. The control device according to claim 1, wherein the standby value of the high voltage node corresponds to the logical power supply voltage $V_{CC}$, this high voltage node being set equal to a higher nominal value $V_{pp}$ in the form of a voltage ramp, and in that the first operating mode corresponds to the standby level of the high voltage input and the second operating mode corresponds to it being set equal to the nominal value.

3. The control device according to claim 1, wherein the control means comprises a first P type MOS transistor, connected between the grid and drain of the said first reference transistor, and a second N type MOS transistor connected between the grid of the said first reference transistor and the ground, the grids of the said transistors being controlled by the logical control signal.

4. The control device according to claim 1, wherein the control means comprises first P type MOS transistors and a second P type MOS transistors connected in series between the logic power supply voltage and the drain of the said second reference transistor, the grid of the first transistor of the said control means is connected in common to the grid of the said first reference transistor, and the grid of the second transistor of the said control means is controlled by the logical control signal.

5. The control device according to claim 1, wherein the control means comprises an N type MOS transistor connected in parallel between the source and drain of the said third reference transistor, its grid being controlled by the said logical control signal.

6. An integrated circuit comprising:

a high voltage translator with cascade transistors; and a control device comprising:

a first P type MOS transistor, connected between a node to which a high voltage signal is applied and a first intermediate node, a second P type MOS transistor connected between the first intermediate node and a second intermediate node, and a third P type MOS transistor connected between the second intermediate node and the ground and with its grid connected to its drain, to supply a reference voltage on one of the said intermediate nodes, and wherein the control device further comprises means of controlling the said reference transistors, either in a first operating mode to force the first reference transistor to act as a current source, the second reference transistor to the blocked state and to short circuit the third reference transistor to the ground, or in a second operating mode to connect each of the said transistors as a diode the grids and drains of the first and second transistors being connected as a function of a logical control signal, to apply reference voltages as bias voltages of the cascade transistors.

7. An integrated circuit comprising:

electrically programmable non-volatile memory elements;

at least one high voltage translator with cascade transistors electrically coupled to the memory elements; and a control device comprising:

a first P type MOS transistor, connected between a node to which a high voltage signal is applied and a first intermediate node, a second P type MOS transistor connected between the first intermediate node and a second intermediate node, and a third P type MOS transistor connected between the second intermediate node and the ground and with its grid connected to its drain, to supply a reference voltage on one of the said intermediate nodes, and wherein the control device further comprises means of controlling the said reference transistors, either in a first operating mode to force the first reference transistor to act as a current source, the second reference transistor to the blocked state and to short circuit the third reference transistor to the ground, or in a second operating mode to connect each of the said transistors as a diode, the grids and drains of the first and second transistors being connected as a function of a logical control signal, to apply reference voltages as bias voltages of the said cascade transistors, applied to the cascade transistors of the at least one high voltage translator.

8. The integrated circuit according to claim 7, further comprising one or more additional control devices for one or more translators.

9. The integrated circuit according to claim 7, further comprising a voltage detector to output the logical control signal of the control means by making a comparison between the level of the high voltage input and a determined threshold.

* * * * *